US006065582A

United States Patent [19]

Seitz

[11] Patent Number: 6,065,582

[45] Date of Patent: May 23, 2000

[54] COIN-CHECKING ARRANGEMENT

[75] Inventor: Thomas Seitz, Geneva, Switzerland

[73] Assignee: Electrowatt Technology Innovation AG, Zug, Switzerland

[21] Appl. No.: 09/142,614

[22] PCT Filed: Mar. 18, 1997

[86] PCT No.: PCT/EP97/01342

§ 371 Date: Sep. 10, 1998

§ 102(e) Date: Sep. 10, 1998

[87] PCT Pub. No.: WO97/35286

PCT Pub. Date: Sep. 25, 1997

[30] Foreign Application Priority Data

Mar. 19, 1996 [CH] Switzerland ..... 718/96

[51] Int. Cl.[7] ..... G07D 5/08

[52] U.S. Cl. ..... 194/317

[58] Field of Search ..... 194/318, 317

[56] References Cited

U.S. PATENT DOCUMENTS 3,986,104 10/1976 Randolph ..... 324/327

4,742,903 5/1988 Trummer ..... 194/317

FOREIGN PATENT DOCUMENTS 0202378 11/1986 European Pat. Off. .

0541323 5/1993 European Pat. Off. .

8300763 3/1983 WIPO .

9102334 2/1991 WIPO .

93/02431 2/1993 WIPO ..... 194/318

*Primary Examiner*—F. J. Bartuska

*Attorney, Agent, or Firm*—Proskauer Rose LLP

[57] ABSTRACT

An arrangement for checking coins wherein the coins (1) move in the checking operation along a side wall (6) of a coin passage (2) and past two coil halves (4*a*, 4*b*) which are disposed opposite each other on both sides of the coin passage (2) and which are connected in series in phase opposition. The coin half (4*b*) which is disposed on the same side of the coin passage (2) as the side wall (6) is of lower resistance than the other coin half (4*a*) and preferably comprises stranded wire.

2 Claims, 1 Drawing Sheet

COIN-CHECKING ARRANGEMENT

Figure 1:
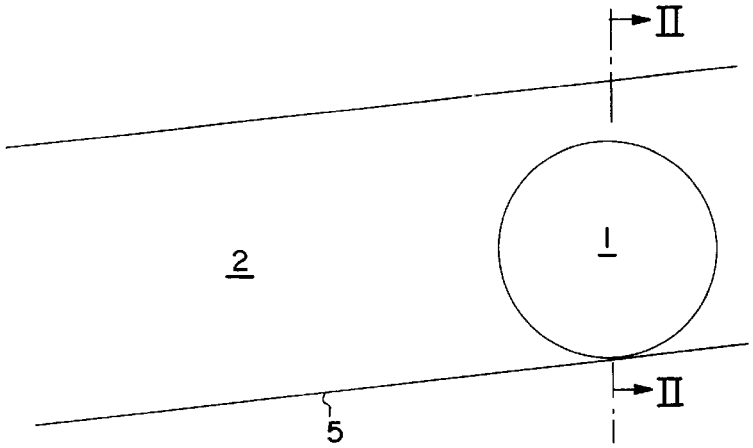

The invention relates to a coin-checking arrangement as set forth in the classifying portion of claim 1.

The arrangement is used in coin-checking units of automatic sales and service apparatuses such as for example telephone stations, automatic drinks- or cigarette-dispensing apparatuses and so forth. The coins are often of a sandwich-type structure, the layers of which comprise differently alloyed, nickel-bearing metals, for example CuNi and Ni.

An arrangement of the kind set forth in the opening part of this specification is known from EP 0 304 535 A1, describing a coin-checking arrangement in which a first coil detects the alloy and a second coil detects the thickness of the coin, wherein the second coil comprises two coil halves which are electrically connected in series or parallel in phase opposition or in in-phase relationship. The coils are each a part of a specific resonance oscillating circuit which is fed with an alternating current by a current source.

The object of the present invention is so to improve the known arrangement that at least the combinational effect of the coin thickness and a sandwich structure of the coin can be ascertained and internal coin layers with 4%, 6% and 8% nickel in a surrounding enclosure of CuNi can be detected, which permits clear identification of the coin in question.

In accordance with the invention the specified object is attained by the features recited in the characterising portion of claim 1. An advantageous configuration of the invention is set forth in the appendant claim.

Figure 2:
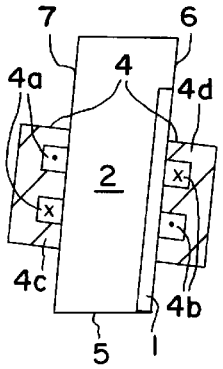
Figure 3:
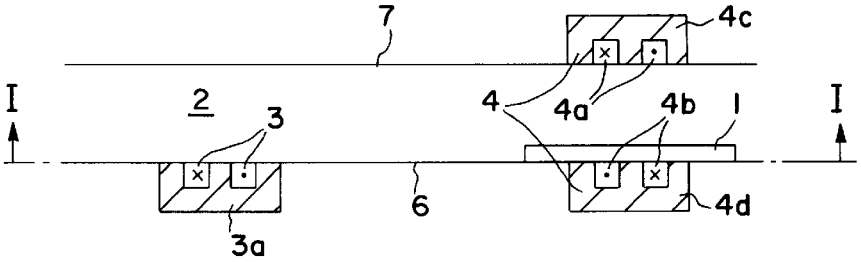
Figure 4:
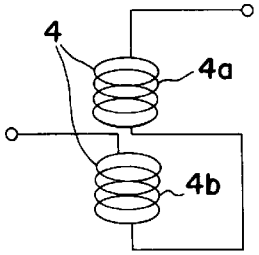

An embodiment of the invention is described in greater detail hereinafter and illustrated in the drawing in which:

FIG. 1 shows a diagrammatic perpendicular longitudinal section of a coin passage, FIG. 2 shows a diagrammatic cross-section of the coin passage, FIG. 3 shows a diagrammatic horizontal longitudinal section of the coin passage, and FIG. 4 shows a series circuit in phase opposition of two coil halves of a coil.

An arrangement for checking coins 1 has a coin passage 2. along which a plurality of coils are arranged in succession in the direction of movement of the coins 1. It is assumed in FIGS. 1 through 3 that there are two coils 3 and 4. The coil 4 serves to ascertain the thickness of the coins 1 to be checked and preferably comprises a first coil half 4*a* and a second coil half 4*b* which, in the arrangement according to the invention, are both electrically connected in series in phase opposition (see FIG. 4) and each have a ferromagnetic core 4*c* and 4*d* respectively. The coil 4 is a part of a resonance oscillating circuit (not shown) which is fed by a current source with an alternating current which produces an alternating magnetic field in the ferromagnetic cores 4*c* and 4*d* of the coil halves 4*a* and 4*b*. The coil 3 in contrast serves to ascertain the alloy composition of the coins 1 to be checked and is disposed on the same side of the coin passage as the coil half 4*b*. The coil 3 is a part of its own resonance oscillating circuit (not shown) which is fed by a current source with an alternating current which produces an alternating magnetic field in a ferromagnetic core 3*a* of the coil 3. The coin passage 2 has a bottom surface 5 which serves as an inclined plane and at least one side wall 6. It is assumed in FIGS. 1 through 3 that there are two parallel side walls 6 and 7. When a coin checking operation is effected the coins 1 roll or slide under the influence of the force of gravity inclinedly downwardly on the inclined plane formed by the bottom surface 5, and in so doing bear against the side wall 6 along which they therefore move. For that purpose the side wall 6 is slightly inclined with respect to the perpendicular so that, as they move along, the coins 1 bear against the side wall 6 under the influence of the force of gravity. To reduce friction the side wall is preferably provided with projecting longitudinal ribs in the direction of the movement of the coins 1 along the coin passage although this is not shown in the drawing. In that case, as the coins 1 roll or slide along the inclined plane, the coins 1 lie against the longitudinal ribs of the side wall 6 so that their spacing relative to the side wall 6 always remains constantly small and irrespective of the coin thickness. The two coil halves 4*a* and 4*b* are arranged in mutually opposite relationship on both sides of the coin passage 2, with their axes extending perpendicularly to the side wall 6. In the checking operation the coins 1 progress in the arrangement along the side wall 6 of the coin passage 2 and in that case move past the two coil halves 4*a* and 4*b* of the coil 4, between which they thus advance. The coil half 4*b* is disposed in the side wall 6, that is to say in that side wall along which the coins 1 progress, while the coil half 4*a* is in the other, opposite, side wall 7. The coil half 4*b*, just like the side wall 6, is always at an identical spacing relative to the coin 1, as measured perpendicularly to the side wall 6, irrespective of the coin thickness, and therefore makes no contribution to measurement of the coin thickness. The latter is ascertained exclusively by the coil half 4*a* whose spacing relative to the coin 1, as measured perpendicularly to the side wall 6, is dependent on the coin thickness. In other words, the eddy currents generated in the metal coin by the movement thereof past the coil cause a change $\Delta R$ in the resistance R of the coil half 4*a*, by virtue of inductive reaction on the coil 4, which change is a measurement in respect of the coin thickness. In the absence of the coil half 4*b*, the level of measuring sensitivity is equal to the relative change in resistance $S=\Delta R/R$, the degree of resolution which can be achieved is equal to 0.05 mm, and the alternating magnetic field in the coin passage 2, which is produced by the coil half 4*a* of the coil 4, is oriented perpendicularly to the coin 1. In the presence of a nickel-bearing coin which is advancing through the coin passage, the field lines of the alternating magnetic field are closed through the coin and the alternating magnetic field does not penetrate deeply into the interior of the coin 1. This is therefore admittedly a good arrangement for measuring the spacing of the coin 1 from the side wall 7 and thus for measuring the coin thickness, but it is not a good arrangement for ascertaining the alloy composition in the interior of the coin 1. In the absence of the coil half 4*b*, it is only possible to provide for coarse detection of the presence of sandwich layers within the coins 1, which for example consist of CuNi on the outside and Ni on the inside. It is however not possible in practice with this structure to ascertain the thickness and the nickel content of the sandwich layers. When checking such coins however it is necessary to be able to detect internal coin layers with 4%, 6% and 8% nickel in a surrounding configuration of CuNi, and that is made possible by the additional provision of the second coil half 4*b*.

By virtue of the two coil halves 4*a* and 4*b* being connected in series in phase opposition, the field lines of the alternating magnetic field of the coil 4 are turned through 90° in the coin passage 2 so that, even in the absence of the coin 1, they no longer extend perpendicularly but parallel to the side walls 6 and 7. When the coin 1 is present, most of the field lines are then closed through the internal nickel layer, which is of a lower reluctance, of the sandwich-structure coin 1, and that provides for good detection of that structure and its alloy composition. The eddy currents produced by the alternating magnetic field flow in the coin 1 around the field lines thereof, that is to say they flow in a direction along a surface of the coin 1 and return in the other direction along the other surface of the coin 1. If the two coil halves 4*a* and 4*b* are identical, that is to say if inter alia they have the same numbers of turns which are wound by means of an identical copper wire, then the two coil halves 4*a* and 4*b* are of the same resistance R. As the two coil halves are electrically connected in series, with the presence of the two coil halves 4*a* and 4*b* the total resistance of the coil 4 is equal to 2R and the measuring sensitivity is equal to $S=\Delta R/2R$ as only the coil half 4*a* makes a contribution worth mentioning to the change in resistance of the coil 4. The total resistance of the coil 4 is thus doubled by the presence of the coil half 4*b* which makes no contribution to $\Delta R$ because of its constant spacing relative to the coin 1, while the level of measuring sensitivity S is halved and thus worsened. That corresponds to an impairment in the degree of resolution from 0.05 mm to 0.1 mm.

In contrast the level of measuring sensitivity is impaired to a lesser degree if the coil half 4*b* with the resistance R' which is on the same side of the coin passage 2 as the side wall 6 is of lower resistance than the other coil half 4*a* involving the resistance R, while preserving the number of turns and the value of the alternating magnetic field. In this case the measuring sensitivity $S=\Delta R/[R+R']$ with R' less than R wherein R' should be as small as possible in relation to R in order to achieve a minimum degree of impairment. The level of measuring sensitivity S is thus noticeably better if the coil half 4*b* of lower resistance is wound by means of stranded wire while the coil half 4*a* is still wound conventionally, for example by means of copper wire. More specifically the total resistance R' of the coil half 4*b* comprises a dc component $R_{DC}$ and an ac component $R_{AC}$ produced by a skin effect, with $R'=R_{DC}+R_{AC}$. In conventional coils of simple copper wire, at frequencies in the kilohertz range, $R_{AC}$ is significantly greater than $R_{DC}$. When using stranded wire for the coil half 4*b* however there is practically no current displacement in the current conductors thereof so that $R_{AC}=0$ and the resistance R' is practically reduced to the dc component $R_{DC}$. In that case $R'=R_{DC}=R/5$. The level of measuring sensitivity of the coil 4 is thereby reduced only to $S=\Delta R/[R+R']=\Delta R/[R+R/5]=[5/6]\Delta R/R$. As the two coil halves 4*a* and 4*b* still have the same numbers of turns and have the same alternating current flowing therethrough, by virtue of their series connection, the difference in terms of their resistances R and R' has no influence on the symmetry of the magnetic field produced by the coil 4 and on the configuration of the field lines thereof.

The measured value of $\Delta R$ is a combinatory function of the coin thickness and the sandwich alloy composition of the coin 1. There is therefore an equation with two unknowns, namely the coin thickness and the alloy composition. In many cases, knowledge of the combinatory effect of the coin 1, that is to say ascertaining $\Delta R$, is sufficient to recognise the authenticity and the value of the coin 1. If however that is insufficient, the alloy composition of the coin 1 also has to be additionally ascertained by means of the coil 3. That gives a second equation so that in total there are two equations with two unknowns, and the solution thereof gives separate values for the two unknowns, namely the thickness and the alloy composition of the coin 1, which two values are characteristic in regard to the authenticity and the value of the coin 1.

What is claimed is:

1. An arrangement for checking coins (1) in which in the checking operation the coins (1) progress along a side wall (6) of a coin passage (2) and move past two coil halves (4*a*, 4*b*) of a coil (4) which are arranged in mutually opposite relationship on both sides of the coin passage (2) and are electrically connected in series in phase opposition, wherein the axes of the two coil halves (4*a*, 4*b*) extend perpendicularly to the side wall (6). characterised in that that coil half (4*b*) which is on the same side of the coin passage (2) as the side wall (6) is of lower resistance than the other coil half (4*a*).

2. An arrangement as set forth in claim 1 characterised in that the coil half (4*b*) of lower resistance is wound by means of stranded wire.

* * * * *